US007057975B2

(12) United States Patent
Stobbe

(10) Patent No.: US 7,057,975 B2
(45) Date of Patent: Jun. 6, 2006

(54) METHOD AND DEVICE FOR AUTOMATIC TIMING IN MASS SPORTING EVENTS

(75) Inventor: Anatoli Stobbe, Barsinghausen (DE)

(73) Assignee: ASTRA Gesellschaft für Asset Management mbH & Co. KG, Barsinghausen (DE)

( * ) Notice: Subject to any disclaimer, the term of this patent is extended or adjusted under 35 U.S.C. 154(b) by 342 days.

(21) Appl. No.: 10/465,737

(22) Filed: Jun. 19, 2003

(65) Prior Publication Data

US 2003/0235116 A1 Dec. 25, 2003

(30) Foreign Application Priority Data

Jun. 20, 2002 (DE) ..... 102 27 451

(51) Int. Cl.
*G04F 8/00* (2006.01)
*G04B 23/00* (2006.01)

(52) U.S. Cl. ..... 368/3; 368/10; 340/323 R; 340/573.3

(58) Field of Classification Search ..... 368/10, 368/47, 107, 276–278, 3, 110, 113; 340/323 R, 340/373.3
See application file for complete search history.

(56) References Cited

U.S. PATENT DOCUMENTS 3,631,453 A * 12/1971 Stalp ..... 340/303
4,752,764 A * 6/1988 Peterson et al. ..... 340/323 R
4,999,604 A * 3/1991 Crews ..... 340/323 R
5,293,354 A * 3/1994 Costabile ..... 368/11
5,457,461 A * 10/1995 Schuermann ..... 342/42
5,511,045 A 4/1996 Sasaki et al.
6,072,751 A * 6/2000 Kirson et al. ..... 368/2
6,233,534 B1 * 5/2001 Morozumi et al. ..... 702/176
6,301,197 B1 * 10/2001 Abbott et al. ..... 368/10
6,369,697 B1 * 4/2002 Poole ..... 340/573.1
6,700,494 B1 * 3/2004 Dowd ..... 340/573.3
6,816,442 B1 * 11/2004 Heiman et al. ..... 368/107
6,870,466 B1 * 3/2005 Rust et al. ..... 340/323 R
2004/0233044 A1 * 11/2004 Carter et al. ..... 340/323 R

FOREIGN PATENT DOCUMENTS

DE 3929048 3/1991
DE 10005169 8/2001

* cited by examiner

*Primary Examiner*—Vit Miska
*Assistant Examiner*—Jeanne-Marguerite Goodwin
(74) *Attorney, Agent, or Firm*—Collard & Roe, P.C.

(57) ABSTRACT

A method and device for automatic timing of mass sporting events is described.

Participants of the mass event each wear a transponder with an individual code, which is read after the finish and is associated with a recorded time. Upon finishing, an internal timer of the transponder is activated and its transponder time is evaluated with the determination of a finish time from the recorded time as the adjustment amount.

20 Claims, 3 Drawing Sheets

METHOD AND DEVICE FOR AUTOMATIC TIMING IN MASS SPORTING EVENTS

The invention relates to a method for automatic timing in mass sporting events according to the preamble of claim 1, as well as a device for automatic timing of mass sporting events according to the preamble of claim 11.

From DE 39 29 048 A1, an automatic timer is known, in particular, for mass sporting events, in which an individual performance test takes place. In this connection, at the start, a code word in a transmission frequency is transmitted from a transponder to a reading apparatus, which starts a timer in the reading apparatus and stops upon finish. Manipulation should be impossible, such that the transmission frequency as well as the code word is evaluated.

The known automatic timers are based on the presumption that with the start as well as with the finish, the code word contained in the transponder can be evaluated instantaneously. This is not the case in practice, however. In addition, a variable time lag exists between the finish and the correct evaluation of the code word stored in the transponder. This time lag is qualified by the quality of the data transmission and by data collision with other transponders. Thus, poor quality of the data transmission requires multiple transmission attempts, until the transponder data are verified as readable. With data collision, caused by multiple transponders, which transmit their data simultaneously or in a time-intersecting manner, a collision resolution must be performed in advance, until the transponder data can be transmitted. The timing can be inaccurate, and therefore, disadvantageous to individual participants.

The object of the present invention is to improve the accuracy of the determination of the finish time with a method and device of the above-described type.

This object is solved by a method and device for automatic timing in mass sporting events having the features of claim 1 and claim 11.

Further embodiments and advantageous forms are provided in the dependent claims.

The invention therefore relates to the determination of the occurrence of the finish first individually by means of the individual transponders instead of by means of the reading apparatus, and the reading apparatus later determines the lapsed time until the reading process or a time designation, from which the lapsed time until the reading process is extracted. The time lag between the determination time and the actual finish time can be varied as desired, because it is correspondingly corrected by means of the transponder time of the internal timer in the transponder upon reading of the transponder data. Also, the cause of the time lag is immaterial.

With a further embodiment, it is provided that the internal timer of the transponder is activated without contact by an electromagnetic field produced on the goal and/or on an intermediate position.

A criterion is therefore created that creates the same requirements for the starting or setting of the internal timer. In addition, the possibility exists of using passive transponders or an appropriate current supply, which are inactive between the start and goal and are first activated upon finish and remain activated until complete transmission of the transponder data.

Indeed, reading with a passive transponder is time-consuming; however, the succession and reading time points are insignifcant for the determination of the finish time, since the transponder time is evaluated for correction.

With the use of active transponders, that is, the type with their own energy sources, the transmission of transponder data, that is, the individual code and the transponder time also take place independently of an activation field or a separate, external electromagnetic field. Thus, also transponders can be used, whose timers are not dependent on an energy supply by means of an external electromagnetic field for a continual timing. Alternatively, then, the transmission of transponder data also can take place acoustically, capacitively, or inductively. Active transponders make possible a fast transmission of transponder data and therewith, a faster determination of the finish time, in particular, with a plurality of participants.

The internal timer can be activated, in particular, with passive transponders by the same electromagnetic field that also serves for reading, or in particular, with passive transponders, it can be activated by a separate activation field.

Since the possible data rate for the transmission of the individual code and the transport time depends on the frequency range used, with transmission frequencies in the long wave range and low frequency range, the transmission time can be so long that it must be considered as the adjustment, or corrected, amount. In addition, temporal overlapping of the transmissions of the transponder with real-time arrival of multiple participants is probable, so that the transmission must be repeated one or more times. In addition, with fast participants, the danger exists that they have again left the finish area before complete data transmission, and therefore, the transmitted data are unusable.

With fast participants and/or a plurality of participants, therefore, it can be advisable to transmit the data from the transponder to the reading apparatus in the HF, VHF, or UHF range. The frequency range to be used for reading can differ from that used for activation of the internal timer of the transponder.

For activating of the internal timer, the long wave range or low frequency range is used, since here, better reproducible field gradients can be obtained, which makes possible a local, distinct activatation of the internal timer of the transponder at a finish line.

It is also possible, however, with slow participants and a minimal number of participants reaching the target area, or finish line, to use the same electromagnetic field as the reading field and the activation field. From the reading apparatus, then, merely one electromagnetic field must be produced, whereby the expenditure and costs of the transponder as well as the reading apparatus are reduced.

By means of the internal timer, a continuous real-time or a continuous relative time or an externally transmitted discrete time designation can be determined.

The real-time measurement requires its own energy source, but has the advantage that systematic inaccuracies of different transponders can later be compensated. The relative time determination can be used also with transponders without internal energy sources. In this case, however, the transponder must be supplied with energy via an electromagnetic field between the time point of the activation of the internal timer and the time point until complete transmission of its data to the reading apparatus.

For determination of an externally transmitted, discrete time designation, also transporters without their own energy sources are suitable, because the timer must not run again or count again. In this case, a storage medium is suited as the timer, which only must be supplied with energy during the storage; afterwards, however, the storage content is retained also without an energy supply.

In addition, by means of the internal timer, intermediate times can be determined and stored in a storage medium, which are supplemented optionally with an identifier of an intermediate position and as a further option, with a data coding.

By means, of these further embodiments, intermediate times can be taken by multiple activations of the internal timer, without having to read the transponder along a stretch between start and finish. The intermediate times can be evaluated first after reaching the finish and reading the individual code and the transponder time. By the identifier, multiple intermediate positions can be distinguished. An additional data coding increases the data reliability. All of these features increase the safety against manipulations, for example, by means of hand transmitters, which only simulate intermediate positions that are not passed.

Further, it is provided that the individual code of the transponder and the transponder time are read upon data collision with other transponders after performance of a validation method.

These features take into consideration the situation that at the finish, multiple participants simultaneously arrive and simultaneously attempt to transmit their data from their transponders to the reading apparatus.

While it can still be possible with few participants that the transponder creates an undisrupted, effective data transmission after randomly selected pauses between disrupted data transmission attempts, with a plurality of participants, this can no longer be expected. Here, the reading apparatus is actively engaged in the sending and transmission behavior of the transponder and a validation method is performed.

In this manner, the data of the individual transponder can be read successively without disruptive effects by other transponders, whereby the succession of the reading can differ from the succession of the arrival of the participants at the finish. This is the case, for example, when the validation method is performed according to a validation algorithm, which determines the transmission succession depending on the individual code of the transponder.

The finish point of the correct reading out of the transponder data is not critical for the finish time, rather the time point at which the finish line was crossed, whose occurrence activates the internal timer of the respective transponder. With a considerable time lag, then, a correct timing is possible.

According to a further embodiment, the beginning of a data transmission from the transponder to the reading apparatus that is later determined to be error-free or alternatively, the end of a data transmission from the transponder to the reading apparatus that is verified as error-free less the transmission time can be evaluated.

These features compensate a delay time provided from the time for the data transmission itself, which particularly, with a minimal transmission rate and/or long data words, would otherwise affect the result.

Next, the invention is described with reference to the accompanying figures. In the figures.

Figure 1:
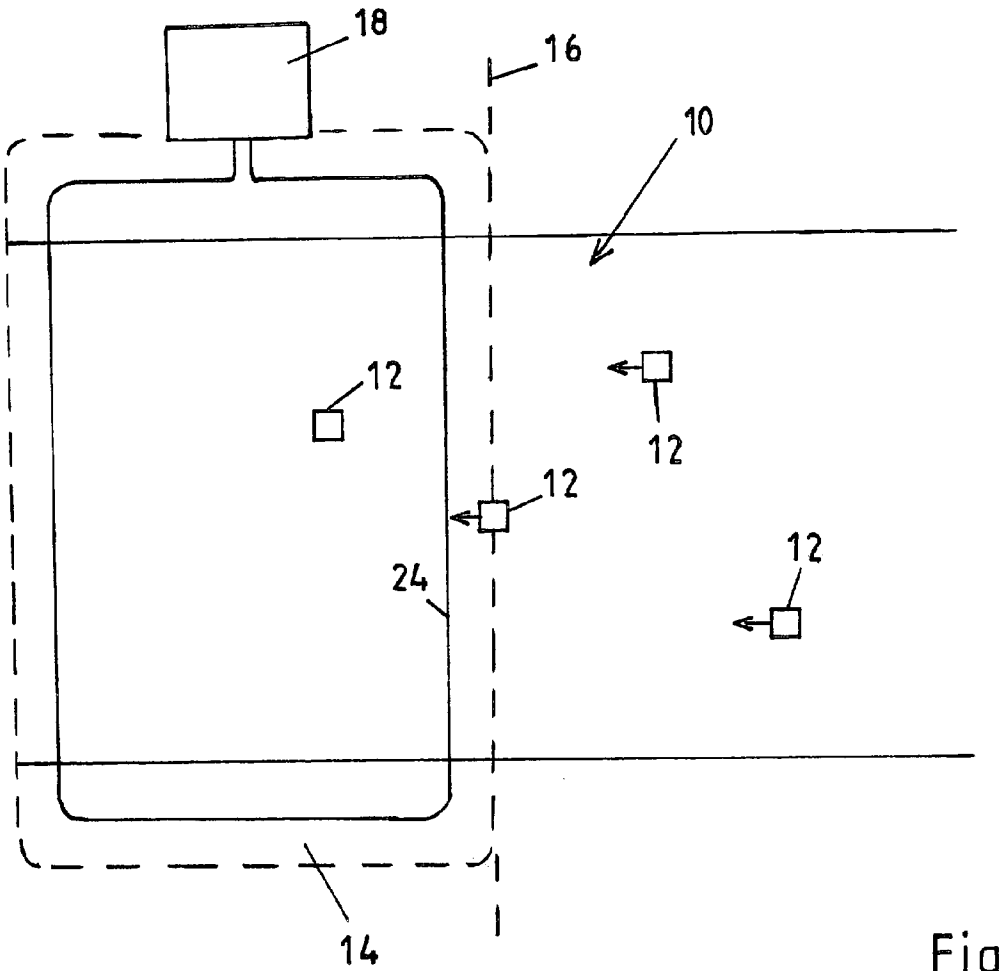
FIG. 1 shows a schematic representation of a finish area with current positions of transponders and a large surface-area reading and activation field.

FIG. 1 shows a representation of a finish area 10 with current positions of transponders 12, which are worn by participants and which arrive with an individual speed into the finish area. In the finish area 10, an electromagnetic reading and activation field 14 is produced by a reading apparatus 18 by means of a large surface-area antenna 24. A border of the reading and activation field 14 represents a finish line 16. The transponders 12, which have crossed the finish line 16, arrive in the electromagnetic reading and activation field 14, in which their transponder data are read in succession with the assistance of the reading apparatus 18. The reading does not take place simultaneously upon arrival of multiple transponders 12 into the electromagnetic reading and activation field 14, rather after collision resolution. Upon crossing of the finish line 16, respectively, an internal timer of the transponder 12 is activated, which determines individually the time between crossing the finish line 16 and the time point of the determination of the transponder data as the transponder time. As the transponder 12, a passive transponder can be used, which draws its energy from the reading and activation field 14.

Figure 2:
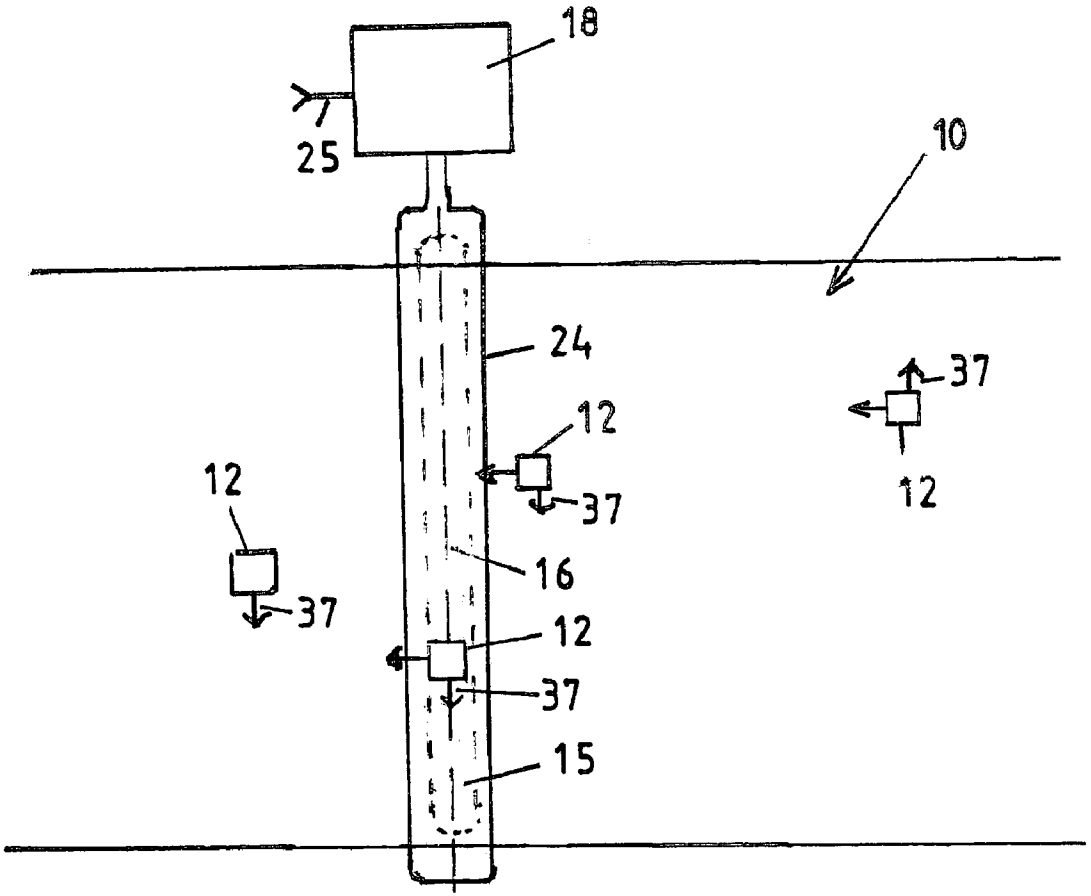
FIG. 2 shows a schematic representation of a finish area with current positions of transponders and an activation field exclusively.

With the embodiment shown in FIG. 2 of a finish area 10 with current positions of transponders 12, a narrow activation field 15 is exclusively produced by means of the antenna 24. The finish line 16 runs here along the center of the activation field 15. The data transmission takes place on another frequency range as that of the activation field 15. The UHF range is suitable, for example. In this connection, the reading apparatus 18 is connected with an antenna 25 via a UHF receiver and the transponder 12 is connected with antennae 37 via a UHF transmitter. The transponders 12 require their own energy sources here.

Figure 3:
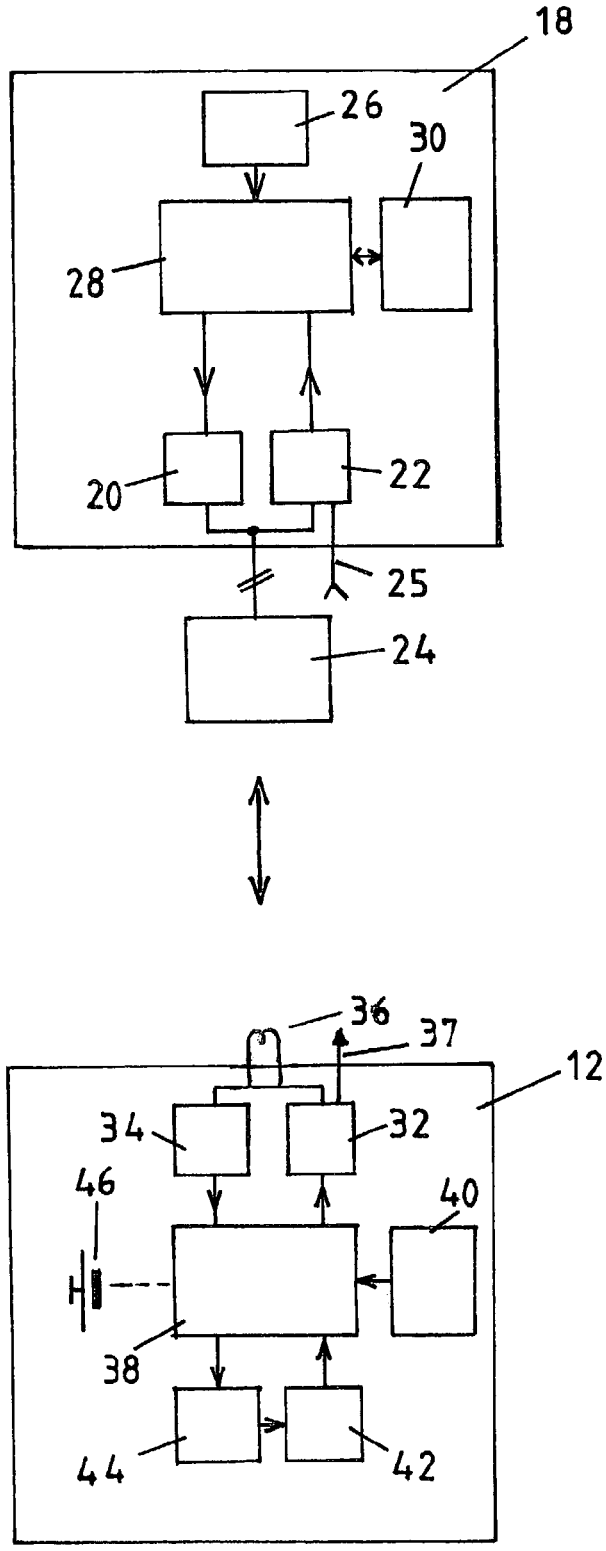
FIG. 3 shows a block diagram of a reading apparatus as well as an exemplary transponder.

FIG. 3 shows a block diagram of a reading apparatus 18 and a transponder 12. The reading apparatus 18 includes a transmitter 20, a receiver 22, and a common antenna 24 for data communication with a transponder 12, as well as a timer 26, a control and evaluation circuit 28, and a storage medium 30. With separate frequency ranges for the activation and the data transmission, the antenna 24 also can be associated exclusively with the transmitter 20 and the receiver 22 associated with a separate antenna 25.

The transponder 12 includes a transmitter 32 and a receiver 34 with a common antenna 36, as well as a control circuit 38, a storage medium 40, an internal timer 42, and an activation circuit 44. If the transponder is an active transponder, the current supply of its components can take place by means of a battery 46, or in other cases, by means of energy transmission from the reading apparatus 18. With separate frequency ranges for the activation and the data transmission, the antenna 36 also can be associated exclusively with the receiver 34 and the transmitter 32 associated with a separate antenna 37.

For performing a validation method, instead of the receiver 22 and the sender 32, also a transceiver can be used on both sides. Thus, the already identified transponders can be shut off after transmission of their transponder data, so that they no longer contribute to the collision.

For preparation of a mass sporting event, first the individual codes of the transponders 12 of the participants can be read at the start and stored in a storage medium 30 of the reading apparatus, so that later, a verification of the utilized transponder 12 in connection with an individual association of the determined times is possible. At the start, the timer 26 of the reading apparatus 18 is started.

As soon as a transponder 12 crosses the finish line 16 and enters into the electromagnetic field 14 of the reading apparatus 18, this event is registered by the receiver 34 of the transponder 12, whereupon the control circuit 38 of the transponder starts the internal timer 42 via the activation circuit 44. With a subsequent data transmission to the reading apparatus 18, the individual code stored in the storage medium 30 as well as the transponder time of the timer 42 are transmitted to the reading apparatus 18 by means of the transmitter 32. If multiple transmission attempts are necessary, the transponder time is always transmitted in an updated manner.

The transponder data received by the receiver 22 of the reading apparatus 18, which contains the individual code as well as the actual transponder time of the timer 42, which has elapsed since passing the finish line 16, are now transmitted to the evaluation circuit 28. The evaluation circuit is determined by subtraction of the transponder time from the recorded time, which is requested from the timer 26, the actual, now error-free finish time. This finish time is associated with the individual code and subsequently stored in the storage medium 30.

With an effective transmission, an acknowledgement signal can be received via the receiver 34 of the transponder, which stops the timer 42 via the control circuit 38. By stopping the internal timer 42, the possibility exists of later requesting the transponder time for a check one more time or if needed, to reset.

For consideration of the pure transmission time until verification of the transponder data, by means of the evaluation circuit 28, the beginning of a data transmission from the transponder 12 to the reading apparatus 18 that is later verified as error-free can be evaluated as the recorded time or, alternatively, the end of a data transmission verified as error-free from the transponder 12 to the reading apparatus 18 less the transmission time can be evaluated.

| REFERENCE NUMBER LIST | |
|---|---|
| 10 | target area |
| 12 | transponder |
| 14 | reading and activation field |
| 15 | activation field |
| 16 | finishing line |
| 18 | reading apparatus |
| 20 | transmitter |
| 22 | receiver |
| 24 | antenna |
| 25 | antenna |
| 26 | timer |
| 28 | evaluation switch |
| 30 | storage medium |
| 32 | transmitter |
| 34 | receiver |
| 36 | antenna |
| 37 | antenna |
| 38 | control circuit |
| 40 | storage medium |
| 42 | timer |
| 44 | activation circuit |
| 46 | battery |

The invention claimed is:

1. A method for automatic timing in a sporting event involving a plurality of participants comprising the steps of:

(a) providing each participant with a transponder, each transponder having an internal timer and an individual code;

(b) activating the internal timer of the transponder of a respective participant when the participant reaches a selected position, the timer being activated by an electromagnetic field;

(c) transmitting transponder data for the respective transponders sequentially to a reading device, the transponder data comprising the individual code and a timer activation time of the transponder, the transponder data being read by the reading device at a reading time; and (d) determining a finish time of the respective participants from a respective evaluation of the timer activation time and the reading time.

2. The method according to claim 1, wherein the electromagnetic field is produced at a goal or at an intermediate position.

3. The method according to claim 2, wherein the transponder data is transmitted and read by means of the electromagnetic field.

4. The method according to claim 3, wherein the transponder data is read upon data collision with other transponders after performance of a separation method.

5. The method according to claim 2, wherein the transponder data is transmitted and read by means of an activation field separate from the electromagentic field activating the internal timer of the transponder.

6. The method according to claim 1, wherein by means of the internal timer, a continuous real-time or a continuous relative time or an externally determined discrete time designation are determined.

7. The method according to claim 1, wherein by means of the internal timer, intermediate times are determined and stored in a storage medium.

8. The method according to claim 7, wherein a code serving for identification of intermediate positions or for validation is transmitted by means of an activation field to the transponder.

9. The method according to claim 1, wherein as the reading time, the beginning of a data transmission from the transponder to the reading device that is later verified as error-free is evaluated.

10. The method according to claim 1, wherein as the reading time, the end of a data transmission from the transponder to the reading device that is verified as error-free less the transmission time is evaluated.

11. An assembly for automatic timing in a sporting event involving a plurality of participants comprising:

(a) a plurality of transponders worn by the participants, each transponder having an internal timer and an individual code, the internal timer of the transponder of a respective participant being activated by an electromagnetic field when the participant reaches a selected position;

(b) a reading device for reading transponder data for the respective transponders sequentially, the transponder data comprising the individual code and a timer activation time of the transponder, the transponder data being read by the reading device at a reading time; and (c) a controller for determining a finish time of the respective participants from a respective evaluation of the timer activation time and the reading time.

12. The assembly according to claim 11, wherein the electromagnetic field is produced at a goal.

13. The assembly according to claim 12, wherein the transponder data is transmitted and read by means of the electromagnetic field.

14. The assembly according to claim 13, wherein the the transponder data is read upon data collision with other transponders after performance of a separation method.

15. The assembly according to claim 12, wherein the transponder data is transmitted and read by means of an activation field separate from the electromagentic field activating the internal timer of the transponder.

16. The assembly according to claim 11, wherein the internal timer is formed as a continuous real-time clock or as a continuous relative timer or as a storage medium for externally transmitted discrete time designations.

17. The assembly according to claim 11, wherein the internal timer includes a storage medium for storage of intermediate times.

18. The assembly according to claim 17, wherein a code serving for identification of intermediate positions or for validation is transmitted by means of an activation field to the transponder.

19. The assembly according to claim 11, wherein as the reading time, the beginning of a data transmission from the transponder to the reading device that is later verified as error-free is evaluated.

20. The assembly according to claim 11, wherein as the reading time, the end of a data transmission from the transponder to the reading device that is verified as error-free less the transmission time is evaluated.

* * * * *

UNITED STATES PATENT AND TRADEMARK OFFICE

CERTIFICATE OF CORRECTION

PATENT NO. : 7,057,975 B2
APPLICATION NO. : 10/465737
DATED : June 6, 2006
INVENTOR(S) : Stobbe It is certified that error appears in the above-identified patent and that said Letters Patent is hereby corrected as shown below:

Column 6, line 61, (Line 1 of Claim 14), after the word "the" (second occurrence), please delete: --the--.

Signed and Sealed this

First Day of August, 2006

JON W. DUDAS
*Director of the United States Patent and Trademark Office*